United States Patent [19]

Governale

[11] Patent Number: 4,691,477

[45] Date of Patent: Sep. 8, 1987

[54] RIGIDIFYING SYSTEM FOR WINDOW ASSEMBLY DURING ITS SHIPMENT AND INSTALLATION

[75] Inventor: Bernard C. Governale, Duluth, Ga.

[73] Assignee: Peachtree Doors, Inc., Norcross, Ga.

[21] Appl. No.: 889,762

[22] Filed: Jul. 28, 1986

[51] Int. Cl.[4] ..... E06B 3/32

[52] U.S. Cl. ..... 49/380; 206/325

[58] Field of Search ..... 49/380; 160/351; 206/325, 321

[56] References Cited

U.S. PATENT DOCUMENTS

| | | | |
|---|---|---|---|
| 2,842,235 | 7/1958 | Stalle | 49/380 X |
| 2,930,480 | 3/1960 | Brown | 49/380 X |
| 3,205,982 | 9/1965 | Chimienti | 49/380 X |
| 3,618,261 | 11/1971 | Torbett | 49/380 |

*Primary Examiner*—Philip C. Kannan

[57] ABSTRACT

To maintain a premanufactured sliding sash window assembly square and distortion-free during shipment and until completely installed in a building, the two vertical sides of the window frame are connected by a tension element which prevents outward bowing of the two frame sides. Protective clips are installed on the top and bottom rails of the exterior sliding window sash near the corners of the sash and are secured to the sash by adjustable clip and sash encircling bands. The upper sash clips include posts which are releasably anchored to interior faces of the window frame. The upper and lower sash clips include vertical spacing fingers which engage between the vertical edges of the exterior sash and opposing vertical faces of the window frame to provide proper spacing of the exterior sash relative to the vertical sides of the frame. The system causes the exterior sash to be locked within the frame near the top of the frame and to form a powerful brace for the window frame during handling, shipping and installation of the window assembly. The rigidifying system is removed from the assembly only after the installation of the assembly is completed.

9 Claims, 9 Drawing Figures

RIGIDIFYING SYSTEM FOR WINDOW ASSEMBLY DURING ITS SHIPMENT AND INSTALLATION

BACKGROUND OF THE INVENTION

1. Technical Field

The present invention relates to a rigidifying system for premanufactured windows which remains with the window assembly during its shipment and installation and is removed only after installation is completed.

2. The Prior Art

A recognized problem in the home construction industry and window manufacturing industry is the problem of maintaining manufactured window assemblies square and distortion-free during their shipment, handling and installation in a building. Frequently, window assemblies are subjected to stresses which permanently distort the rectangular window frame, causing misalignment and binding of the sliding window sashes in the frame of the manufactured window assembly. These damaging stresses can occur during shipment or other handling, and most frequently occur during the installation of the window assembly in an opening provided in the wall of a building. Once the frame of the window assembly becomes distorted and remains distorted after the installation of the window assembly, it is very difficult or impossible to correct the distortion and provide proper operation for the window sashes subsequently.

In the prior art, some attempts have been made to rigidify manufactured window assemblies during shipment and handling. Usually, this involves the application of tight banding around the frame of the window assembly or across the frame vertically and/or horizontally. In all known prior art rigidifying systems, the rigidifying elements must be removed prior to the installation of the window assembly, thus defeating one of the main objectives of the present invention, namely, that of maintaining the window assembly square, distortion-free and rigid until it is completely installed in a window opening of a building.

An important object of the present invention is to provide a rigidifying system for a window assembly which will not mar or otherwise damage the assembly and which is easily removable following the installation of the assembly in a building.

A further object is to provide a rigidifying system of the above character which is inexpensive to manufacture and install, as well as convenient.

Other features and advantages of the invention will become apparent to those skilled in the art during the course of the following detailed description.

SUMMARY OF THE INVENTION

The present invention is best summarized as a rigidifying system for manufactured window assemblies which prevents outward bowing of the vertical frame members of the assembly, and transforms one sliding sash of the window assembly into a powerful fixed brace which maintains the window frame square and resistant to deformation during shipment, subsequent handling and during the installation of the window assembly.

The system includes a tension element connected between the two vertical sides of the window frame and upper and lower corner clip elements on one sliding sash, secured by adjustable tension straps, with the upper clip elements removably anchored to the vertical frame sides of the window assembly, and both the upper and lower pairs of clip elements having spacer fingers which engage between the vertical edges of the sash and the opposing faces of the vertical frame member.

DETAILED DESCRIPTION

Figure 1:
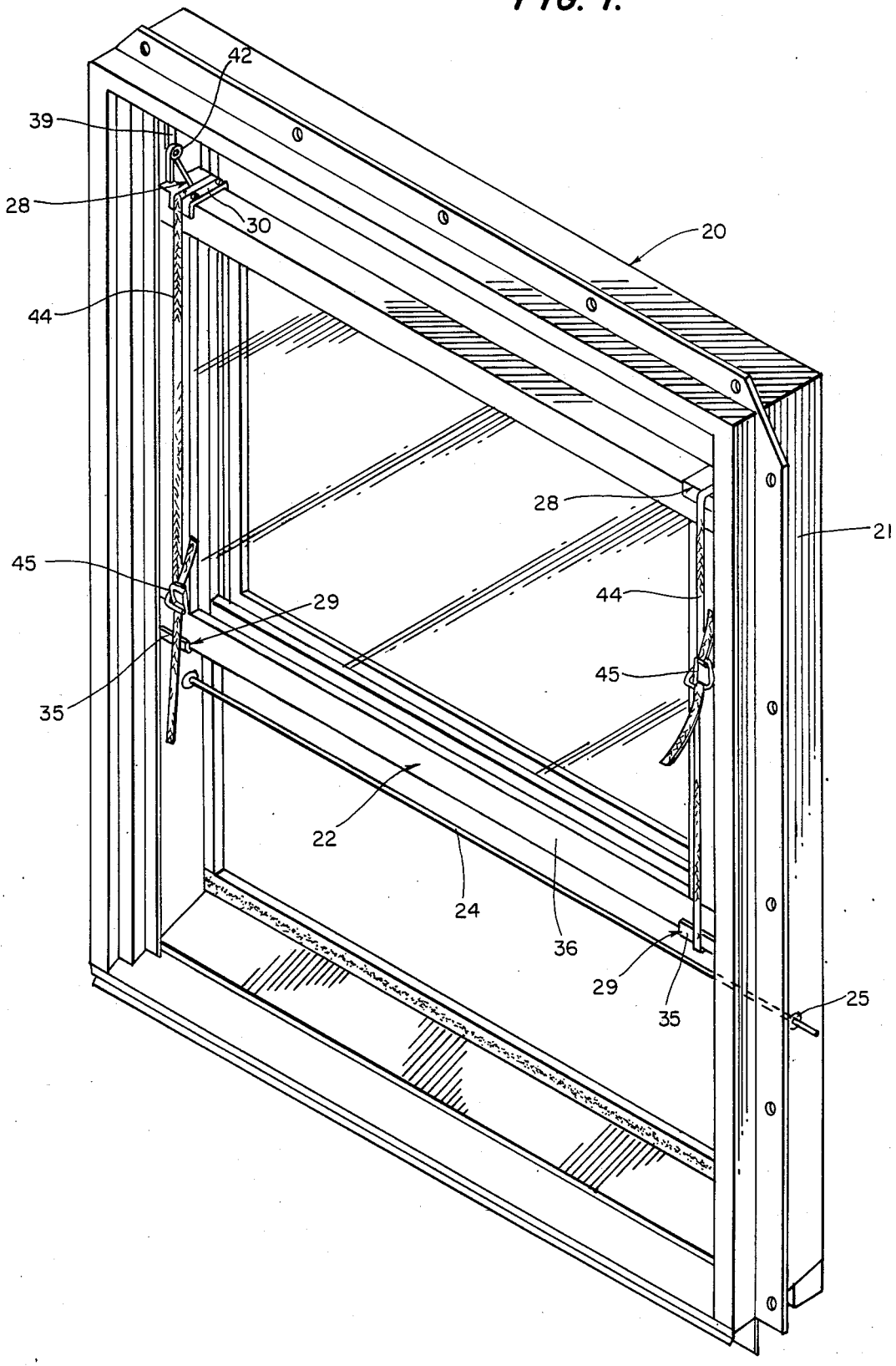
FIG. 1 is a perspective view of a manufactured sliding sash window assembly equipped with a rigidifying system in accordance with the present invention.

Referring to the drawings in detail wherein like numerals designate like parts, a well-known manufactured sliding sash window assembly 20 includes a rectangular frame 21 within which is held on suitable guideways exterior and interior rectangular sliding sashes 22 and 23. The manufactured window assembly 20 per se is conventional in construction and need not be further described to enable a full understanding of the present invention.

The subject matter of the present invention is a rigidifying system for the window assembly 20, which system includes a transverse horizontal tension cord or element 24 extending between and interconnecting the two vertical side members of the window frame 21 to prevent these members from becoming bowed outwardly between their ends during shipment and handling of the assembly 20 and during the procedure of installing the window assembly in a prepared wall opening. The condition whereby the vertical frame members become outwardly bowed due to stresses is sometimes called "pickle barreling" of the frame 21, which is highly undesirable.

Figure 9:
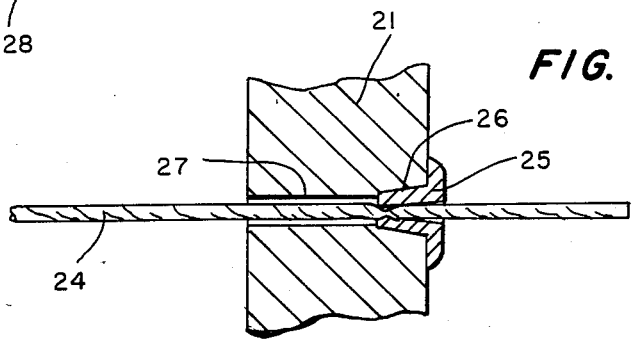
FIG. 9 is an enlarged fragmentary horizontal section taken on line 9—9 of FIG. 2.

The tension cord 24 which prevents pickle barreling of the frame 21 is located near and below the vertical center of the frame 21, as shown in the drawings. The cord 24 is held under tension by a pair of deformable metal gripping elements 25 whose shanks are received in openings 26 formed in the vertical members of the frame 21, FIG. 9. The tension cord or element 24 is also received in openings 27 formed in the vertical members of the window frame 21. The tensioning cord 24 is allowed to remain in place on the window assembly 20 until the installation of the window assembly is completed, after which the cord 24 is cut and removed and discarded along with the gripping elements 25.

The rigidifying system additionally comprises right and left hand top sash clips 28 formed of tough plastics material and bottom sash clips 29 formed of the same material. The pairs of clips 28 and 29 are applied to the exterior sliding window sash 22, as shown in the drawings.

The top clips 28 include channel bodies 30 whose downturned flanges 31 embrace the top horizontal rail 32 of the exterior sash 22. A pair of depending vertical thin spacer fingers 33 carried by each top clip 28 engages between the vertical edges of the sash 22 and the opposing surfaces 34 of the window frame 21 to assure the proper lateral spacing of the sash 22 in the frame 21.

Figure 4:
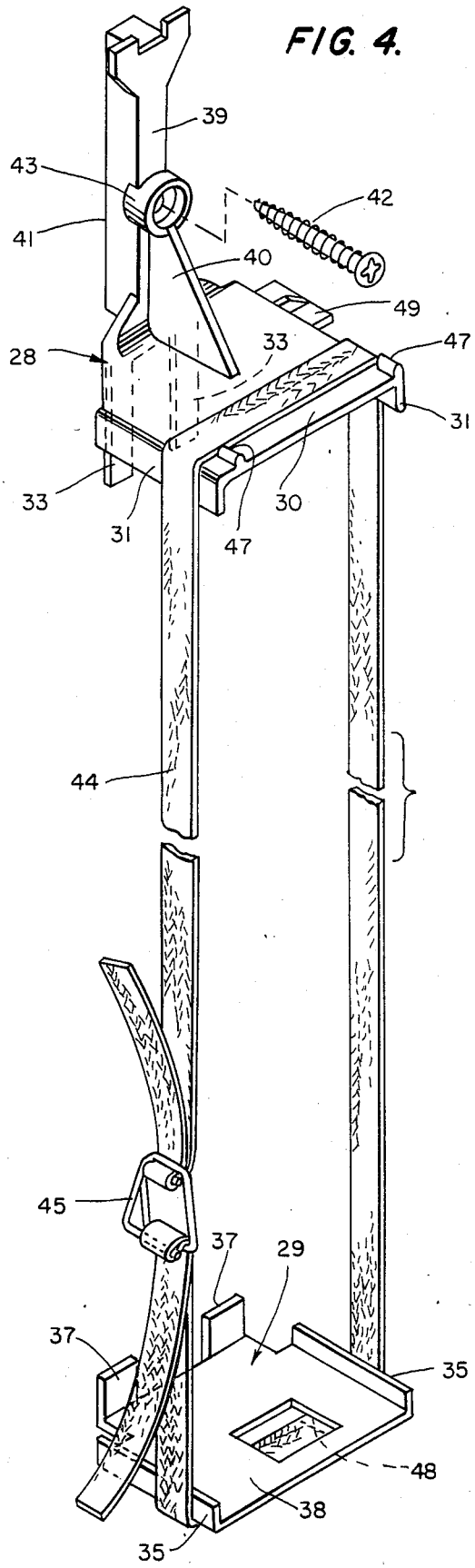
FIG. 4 is a fragmentary perspective view showing elements of the rigidifying system applied to a sliding sash of the window assembly.

Similarly, the bottom clips 29 include side flanges 35 which embrace the bottom rail 36 of the sash 22 and a pair of upturned spacer fingers 37 which engage between the side vertical edges of the sash 22 and the opposing faces of the frame 21 to maintain the proper lateral spacing of the sash 22 within the window frame. The flanges 35 and spacer fingers 37 are integrally attached to a flat plate body 38 of each bottom clip 29, FIG. 4.

Figure 5:
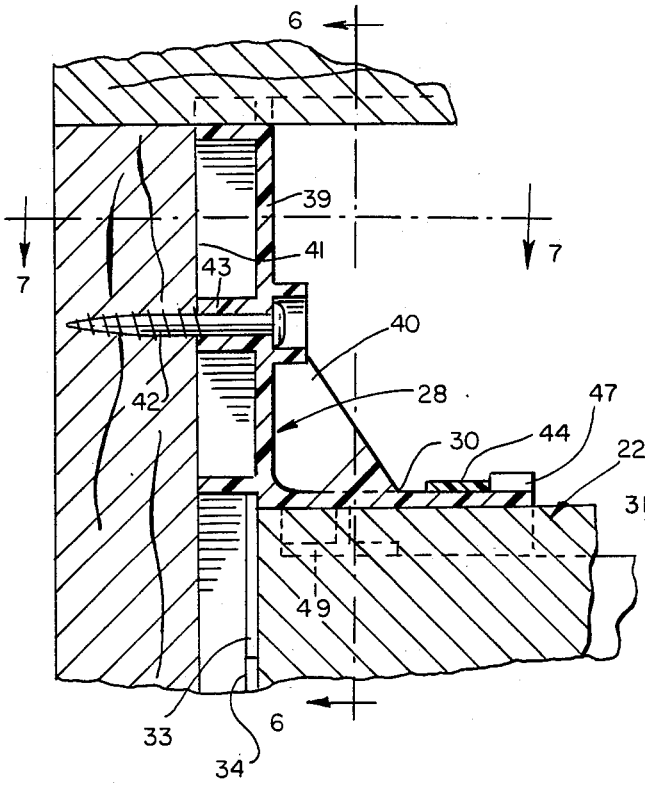
FIG. 5 is an enlarged fragmentary vertical section taken on line 5—5 of FIG. 3.
Figure 6:
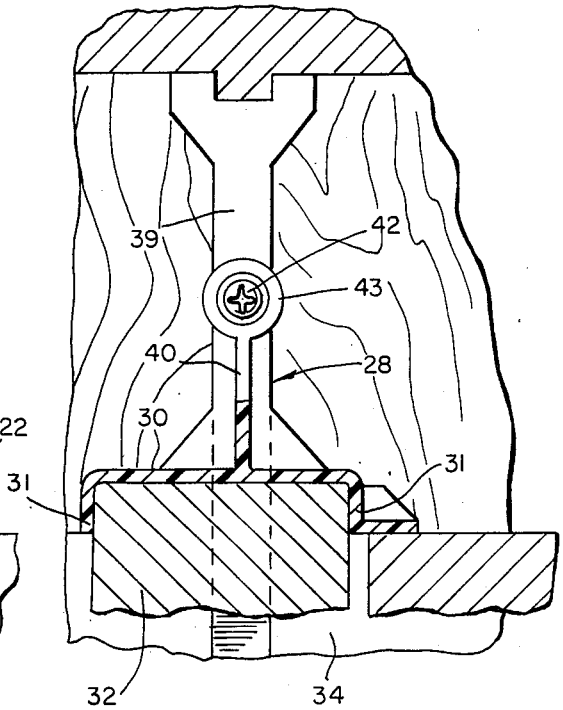
FIG. 6 is a vertical section taken on line 6—6 of FIG. 5.
Figure 7:
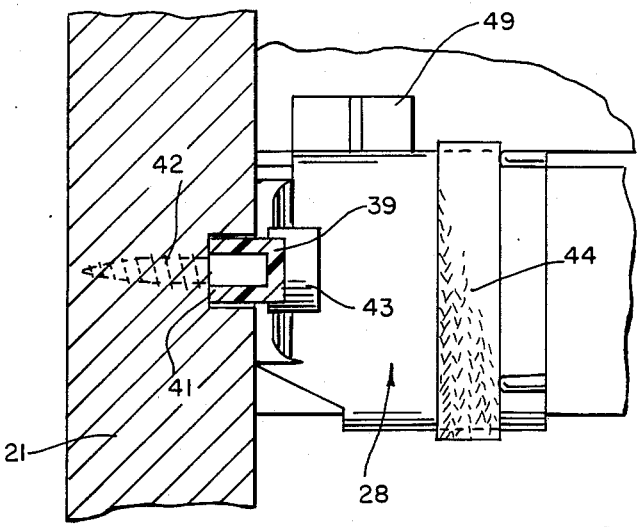
FIG. 7 is a fragmentary horizontal section taken on line 7—7 of FIG. 5.

Each top clip 28 includes a rigid vertical post 39 connected with the channel body 30 through a gusset 40. The vertical face 41 of each post 39 abuts a recessed surface of the frame 21, and an anchor screw 42 is received through an apertured boss 43 of each post 39 and penetrates the adjacent vertical member of the frame 21, FIG. 5, to firmly anchor each top clip 28 to the window frame, in accordance with a very important feature of the invention, soon to be made apparent.

Figure 2:
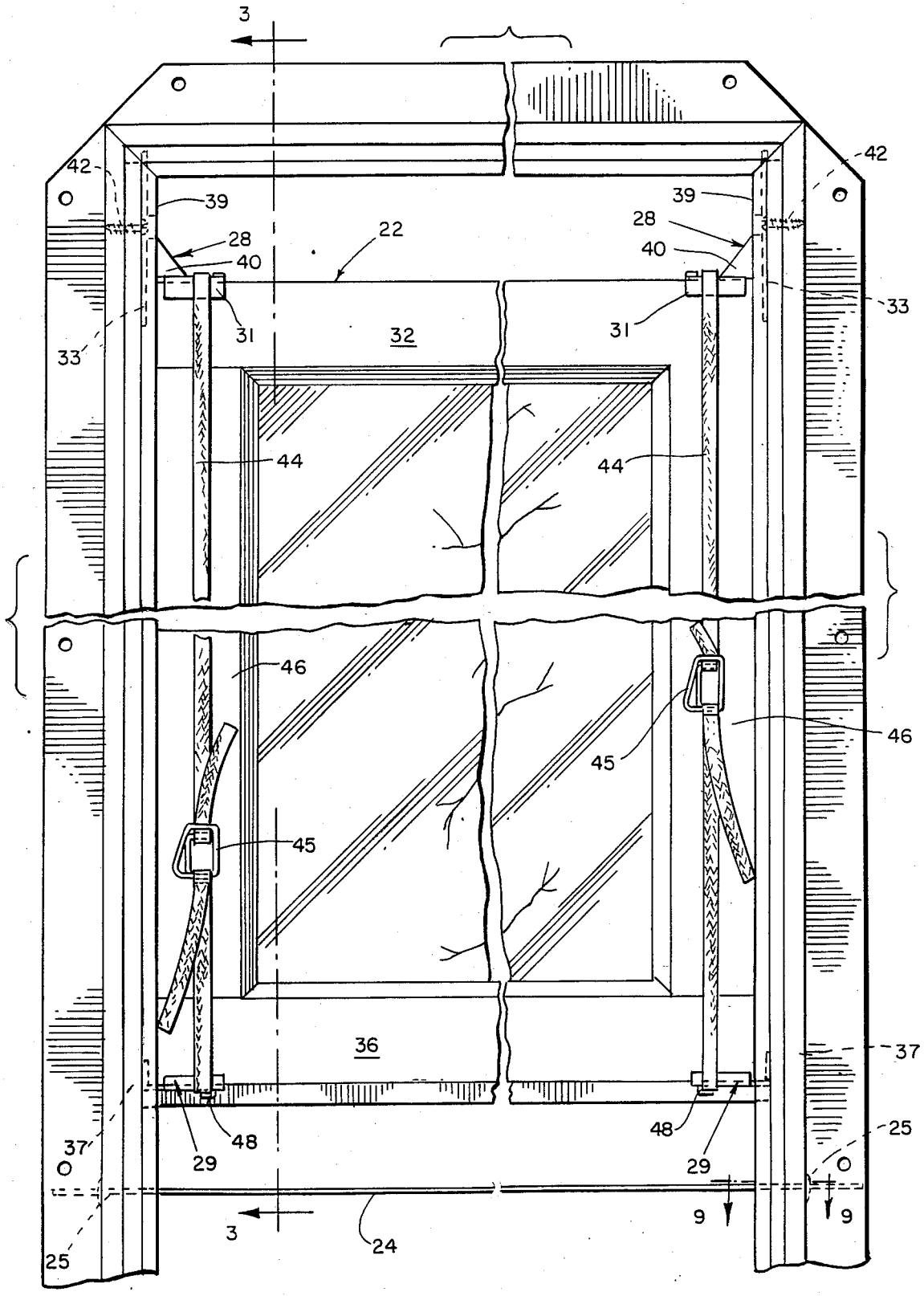
FIG. 2 is a fragmentary front elevation of the window assembly and rigidifying system as shown in FIG. 1.
Figure 3:
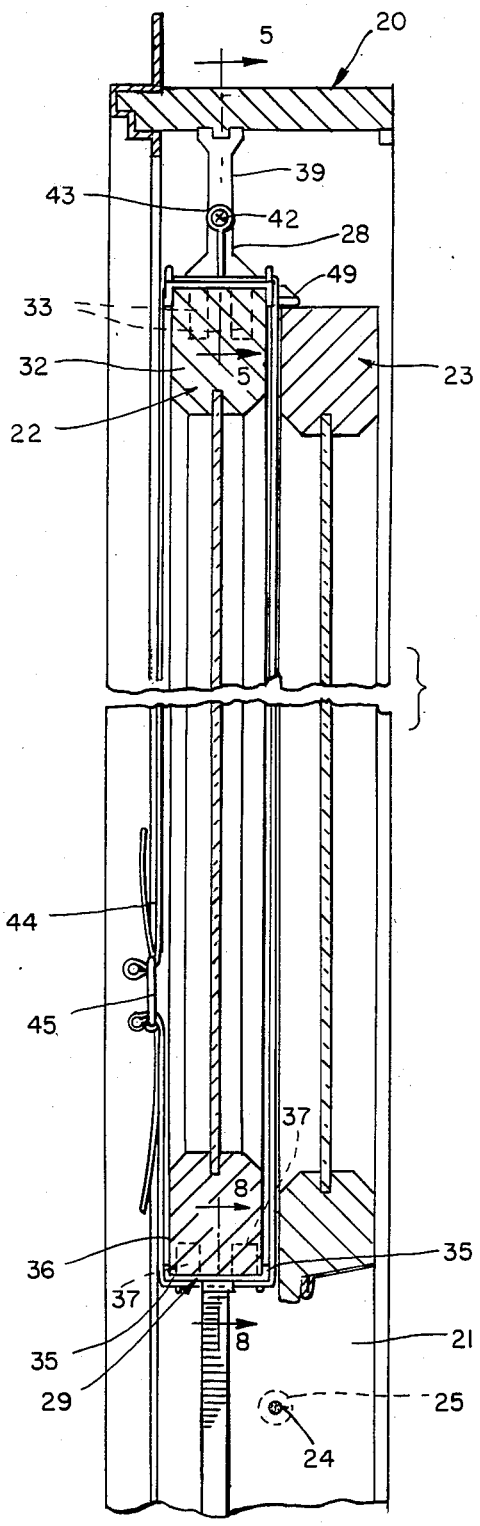
FIG. 3 is a vertical section taken on line 3—3 of FIG. 2.
Figure 8:
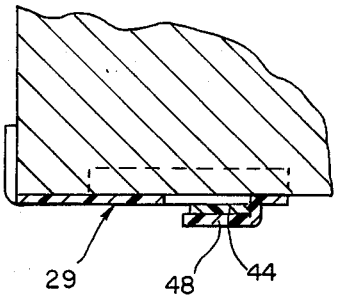
FIG. 8 is an enlarged fragmentary vertical section taken on line 8—8 of FIG. 3.

The top and bottom pairs of clips 28 and 29 located near the corners of the sash 22 are secured tightly to the sash 22 by vertical sash and clip encircling straps 44 having adjusting buckles 45. The two straps 44 lie along the stiles 46 of the exterior sash 22, FIG. 2, and pass over the tops of channel bodies 30 and beneath the plate bodies 38 of clips 28 and 29, respectively, FIG. 4. The top clips 28 have locator lugs 47 for the straps 44 and the clips 29 have depressed locator tongues 48 for the straps, as best shown in FIG. 8.

It may be seen that the tension straps 44 tightly bind the clips 28 and 29 releasably to the sash 22, thereby, in effect, unitizing the four clips with the sash 22. Since the screws 42 anchor the top clips 28 to the frame 21, the rigidifying system effectively causes the exterior sash 22 to serve as a powerful stationary brace for the entire window assembly 20, during its shipment, handling and, most importantly, during its installation in a building wall opening.

The screws 42, straps 44 and clips 28 and 29 are not removed from the assembly until after the completion of the installation of the assembly in a building. In accordance with the main objective of the invention, the window assembly, and particularly the frame 21, is made resistant to deformation in all directions by the rigidifying system until after the installation of the window assembly has been completed. At that time, and only at that time, is the cord 24 cut and removed and the straps 44 released and the clips 28 and 29 removed. The elements forming the rigidifying system do not mar or damage the window assembly in any way, and the system contributes greatly to the ultimate squareness and smooth operation of the window sashes throughout the useful life of the window assembly.

The top clips 28 on corresponding sides thereof include laterally projecting stop plates 49 whose purpose is to limit the upward movement of the interior window sash 23 relative to the fixed exterior sash 22. If the interior sash 23 is allowed to rise in the window frame beyond a certain point, its built-in balancing system can be adversely effected.

As shown in the drawings, with the top clips 28 in place and secured by the screws 42, the window sash 22 is held near and slightly below the top of the frame 21.

The rigidifying system is characterized by simplicity of construction, economy of manufacturing, and convenience of use.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A rigidifying system for a sliding sash window assembly comprising:

a tensioning element removably connected between vertical sides of a frame of the assembly to prevent outward bowing of said vertical sides, holding means for one sliding sash of the window assembly including clip elements secured to the top corner regions of such sash, means releasably anchoring said clip elements to said vertical sides of said frame, said holding means further comprising tensioning straps encircling said one sliding sash vertically and engaging and holding said clip elements, and additional clip elements on the bottom of said one sliding sash and being engaged and held by said tensioning straps.

2. A rigidifying system for a sliding sash window assembly as defined in claim 1, and said last-named means comprising posts on the clip elements extending substantially to the top of said frame and having apertures, and fasteners received through said apertures and penetrating said vertical sides of the frame.

3. A rigidifying system for a sliding sash window assembly as defined in claim 2, and said fasteners comprising screws.

4. A rigidifying system for a sliding sash window assembly as defined in claim 1, and stop extensions on the first-named clip elements serving to limit upward movement of the other sliding sash of the window assembly.

5. A rigidifying system for a sliding sash window assembly as defined in claim 4, and locator elements for the tensioning straps on the first-named and said additional clip elements.

6. A rigidifying system for a sliding sash window assembly as defined in claim 1, and vertical spacer fingers on the first-named and said additional clip elements engaging between the opposite side edges of said one sliding sash and opposing vertical faces of the vertical sides of said frame to maintain said one sliding sash centered laterally in said frame.

7. A rigidifying system for a sliding sash window assembly as defined in claim 1, and said tensioning element comprising a flexible element received through apertures in the vertical sides of said frame, and gripping elements on said frame grippingly engaging said flexible element to hold it under tension.

8. A rigidifying system for a sliding sash window assembly comprising:

removable means connected between vertical sides of a frame of the assembly and preventing outward displacement of the vertical sides, means embracing one sliding sash of said assembly and being releasably anchored to the vertical sides of said frame, whereby said one sliding sash serves as a stationary brace for said assembly during shipment, handling and installation thereof in a wall opening, said means embracing said one sliding sash comprising a pair of top-to-bottom sash encircling adjustable tension straps, and top and bottom pairs of clip elements having channel portions engaging the top and bottom edges of said one sliding sash and being in fixed engagement with said sash by said straps.

9. A rigidifying system for a sliding sash window assembly as defined in claim 8, and vertical posts on said top clip elements extending substantially above the top clip elements, and releasable fastener means anchoring said posts to the vertical sides of said frame.

* * * * *